United States Patent [19]

Keeley et al.

[11] 3,931,785

[45] Jan. 13, 1976

[54] AUTOMATIC FIRE ALARM

[76] Inventors: James R. Keeley, 10627 25th S.W., Seattle, Wash. 98146; Russell Everson, 2041 S. 320th No. 160, Federalway, Wash. 98002

[22] Filed: Nov. 18, 1974

[21] Appl. No.: 524,662

[52] U.S. Cl. ..... 116/106; 340/250; 340/396

[51] Int. Cl.[2] ..... G08B 17/00

[58] Field of Search ..... 116/106; 340/250, 227, 340/219

[56] References Cited

UNITED STATES PATENTS 2,625,902 1/1953 Sorensen ..... 116/106

*Primary Examiner*—Harold I. Pitts

[57] ABSTRACT

This device comprises an audible alarm member arranged to be sounded by spring operated clapper means which is normally held inoperative by temperature responsive devices all in a perforated housing suitable for installation in a room. The temperature responsive devices include a body of wax like material disposed between two cup shaped members of good heat conductive material and holding said members apart at all ordinary room temperatures. If the temperature surrounding the device is raised to a predetermined limit, as by a fire in the room, the wax body will soften or melt and this will permit the cup shaped members to be moved and cause the alarm to be sounded.

4 Claims, 4 Drawing Figures

Fig. 1
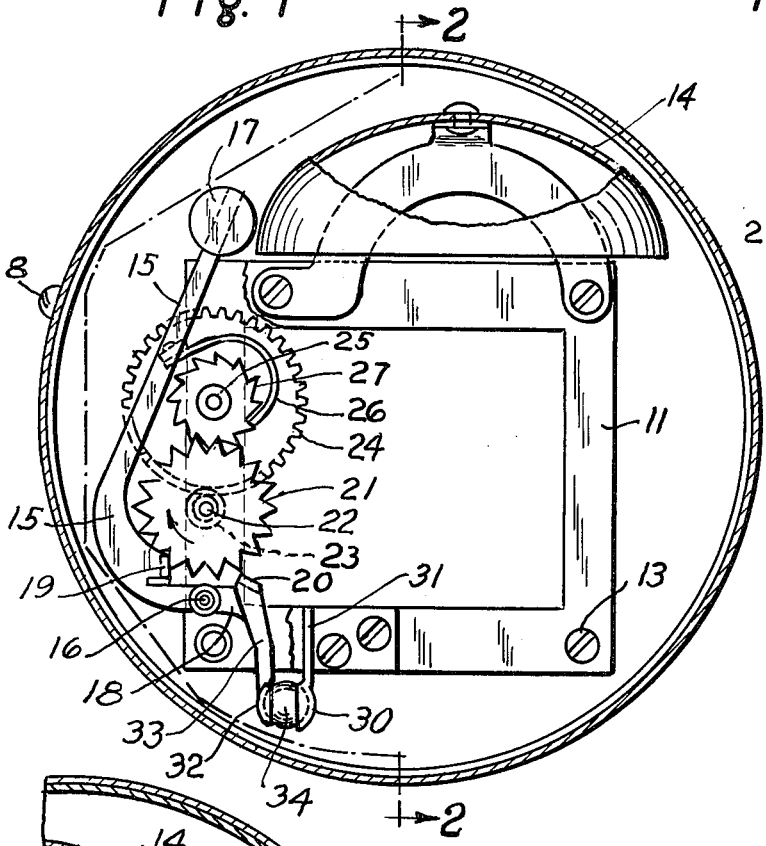
Fig. 2
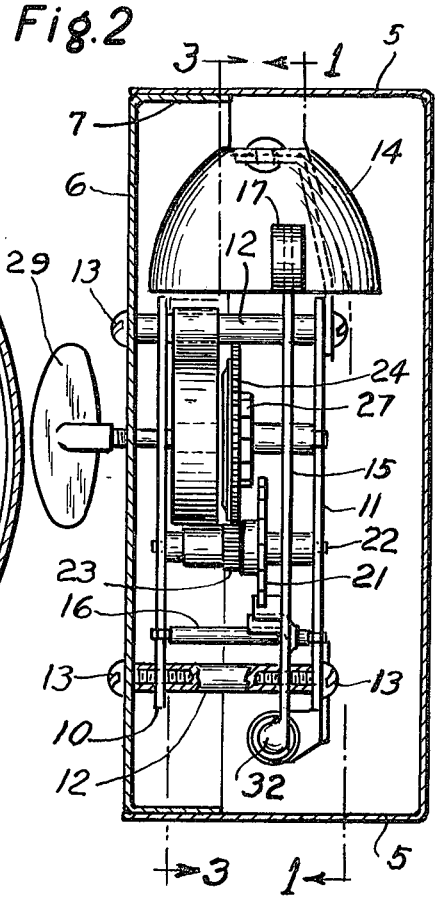
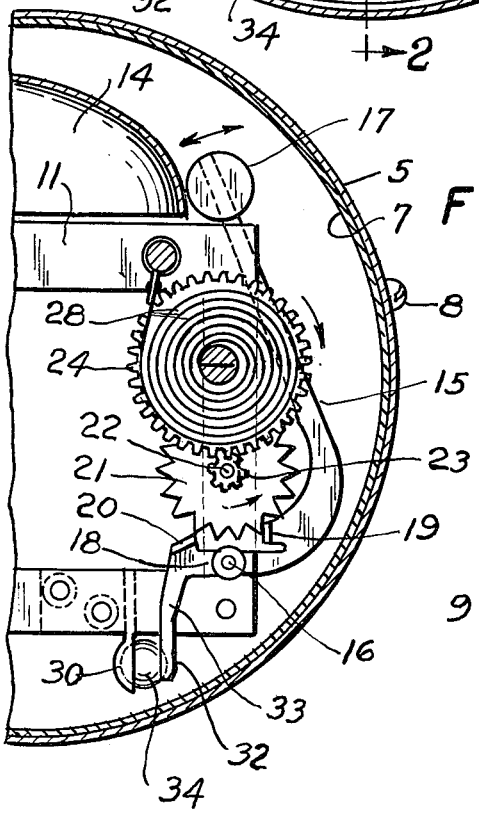
Fig. 3
Fig. 4
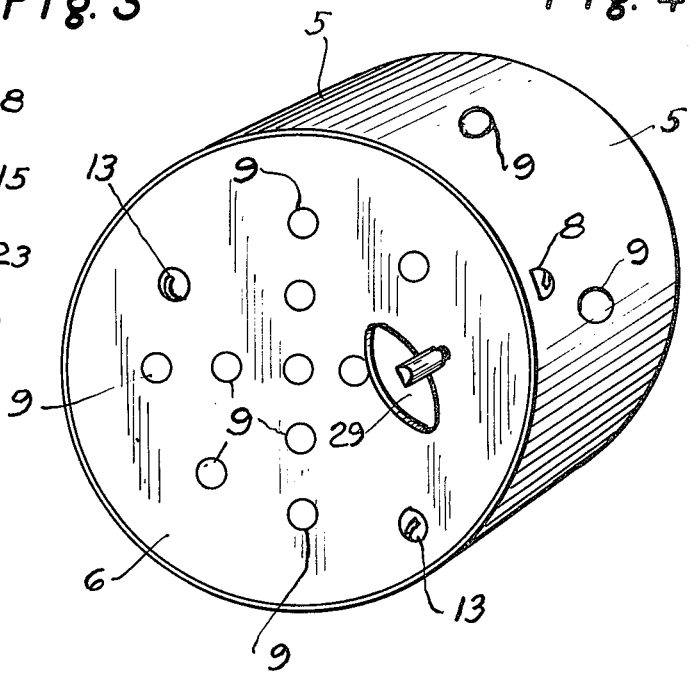

AUTOMATIC FIRE ALARM

SUMMARY OF THE INVENTION

This invention relates to automatic fire alarm devices of a type adapted to be used in a room to sound an alarm if the temperature in that room exceeds a predetermined limit and particularly it relates to heat responsive means used to control the operation of such devices.

Persons asleep in rooms frequently suffer serious and sometimes fatal injury before or without waking up if a fire is started in the room. An object of this invention is to provide a simple and efficient fire alarm device for use in a room and adapted to sound an alarm if the temperature in the room rises above a predetermined maximum, said device being provided with simple and inexpensive heat responsive means which is rugged, durable and not easily damaged in handling, said heat responsive means comprising a body or ball of wax like material disposed between two opposed cup shaped members of good heat conductive material. Said body being firm at ordinary room temperatures and normally holding said two cup shaped members apart, one of the cup shaped members being rigidly secured to a frame and the other cup shaped member being secured to a movable clapper arm which is adapted to be moved and sound the alarm when it is released for movement by the softening or melting of the heat responsive body.

Another object is to provide automatic fire alarm means of this type in which all of the parts are completely housed within a perforated housing of heat conductive material so they cannot be easily damaged by handling the device or tampering with it and will always be maintained at the temperature of the room in which they are disposed.

Other objects of the invention will be apparent from the following description and accompanying drawings.

BRIEF DESCRIPTION OF THE DRAWINGS

FIG. 1 is a view partly in elevation and partly in section, taken substantially on line 1—1 of FIG. 2, showing a fire alarm device embodying our invention.

FIG. 2 is an elevational view, with parts in section, taken on line 2—2 of FIG. 1.

FIG. 3 is a fragmentary sectional view, with parts in elevation, taken on line 3—3 of FIG. 2.

FIG. 4 is a perspective view showing the exterior of the device.

Like reference numerals refer to like parts throughout the drawings.

DESCRIPTION OF THE PREFERRED EMBODIMENT

The fire alarm device herein illustrated comprises a housing preferably formed of a deeper part 5 and a shallower end or cover part 6. The end part 6 has a flange 7 adapted to fit snugly within the housing part 5 and to be secured thereto by screws 8. Enough perforations 9 are provided, in either the housing part 5 or the end part 6, or in both of said parts, to insure that, when parts 5 and 6 are in assembled relation, the air in the room in which the housing is disposed will circulate freely through the housing and always keep the temperature in the housing approximately the same as it is in the room. Preferably the alarm mechanism is assembled in or on one of the housing parts, in this instance the end part 6, and the other housing part 5 is adapted to be secured to a wall or a ceiling of the room in which the alarm device is installed.

The alarm mechanism comprises a frame preferably formed of two frame plates 10 and 11 supported by spacer members 12 in relatively rigid, spaced apart, parallel relation. Screws 13 can be used to secure one frame plate 10 to the housing part 6.

A bell 14 is supported by the frame and a clapper arm 15 is mounted on the frame by a pivot member 16 and carries a striker member 17 positioned to ring the bell 14 when the clapper arm 15 is oscillated. Also said clapper arm 15 has a part 18 which extends beyond its pivot 16 and said clapper arm 15 is provided at opposite sides of its pivot 16 with two spaced apart escapement members 19 and 20 which are shaped and positioned for operative engagement with triangularly shaped teeth on an escapement wheel 21. The clapper arm 15 is normally held immovable but if it is released and free to move it can be oscillated and caused to ring the bell 14 by imparting rotation to the escapement wheel 21.

The escapement wheel 21 is rigidly secured to a shaft 22 which also has a gear pinion 23 rigidly secured to it and pinion 23 meshes with a gearwheel 24 that is rotatively supported on a shaft 25. The gear wheel 24 is connected by a pawl 26 with a ratchet wheel 27 which is rigidly secured to the shaft 25. A spirally wound spring 28 of the type commonly used as a mainspring in clocks has its outermost end attached to the frame and its innermost end attached to the shaft 25. An end of the shaft 25 is accessable from the exterior of the housing for wind-up purposes. When clapper arm 15 is held immovable with its tooth like part 19 seated between two adjacent teeth of the escapement wheel 21 the gears 23 and 24, pawl 26 and ratchet wheel 27 allow the spring 28 to be wound up by applying a winding member 29 to the shaft 25.

Temperature responsive means is provided for holding the clapper arm 15 immovable at all temperatures below a predetermined maximum. This means comprises a cup shaped member 30 rigidly attached to the frame part 12 by a bracket 31 and a second cup shaped member 32 rigidly attached to an extension arm 33 of the clapper arm 15. Cup members 30 and 32 are preferably formed of metal having good heat conductive characteristics and they are positioned with their concave sides in opposed relation and are normally held a short distance apart by a body 34 of heat responsive material which is interposed between them and fits snugly within them and has close heat conductive contact with them so air temperatures around the cup members will always be transmitted instantly to the body 34.

Normal room temperature is usually below 100 degrees Fahrenhiet. The melting temperature of the body 34 is between 130 and 140° F and preferably about 135°. Applicants find that if body 34 is composed of a wax made from petroleum, similar to the wax from which ordinary candles are made, it will remain firm and fairly solid and will not soften objectionably as long as the surrounding temperature remains below 130°, but will soften and release the clapper arm 15 and cause the sounding of the alarm at a temperature of about 135°. One wax found satisfactory for use in forming body 34 is made by Standard Chevron Company of California and is available on the market under the name "STANDARD CHEVRON WAX".

Preferably this fire alarm is secured to a wall near the ceiling or to the ceiling of a room where it is out of the way and not liable to be tampered with, and where temperature is usually the highest in the room. If a fire occurs in the room and raises the temperature around the fire alarm device high enough to melt or greatly soften the body 34 the arm 15 will be released and the spring 28 will operate to sound the alarm.

We claim:

1. In fire alarm means, a frame; a sound producing device; a pivotally mounted arm capable, when oscillated, of sounding said sound producing device; spring actuated arm oscillating means connected with said arm; a cup shaped member rigidly supported from said frame; another cup shaped member rigidly supported by said arm, said two cup shaped members being formed of material having good heat conducting characteristics and being positioned close together with their concave sides in opposed relation; and a body of heat responsive material which is firm at normal room temperatures and has a melting temperature substantially in excess of normal room temperature, interposed between and filling said cup shaped members, said body holding said cup shaped members apart at normal room temperatures and softening and bringing about oscillation of said arm and sounding of said sound producing devices when subjected to a temperature substantially in excess of normal room temperature.

2. The fire alarm device as claimed in claim 1 in which the melting temperature of the heat responsive body is between 130° and 140°F.

3. The fire alarm device as claimed in claim 1 in which the melting temperature of the heat responsive body is about 135°F.

4. The fire alarm device as claimed in claim 1 in which the heat responsive body is composed of wax derived from petroleum.

* * * * *